United States Patent [19]

McWethy

[11] Patent Number: 4,525,975

[45] Date of Patent: Jul. 2, 1985

[54] MODULAR HIGH RISE CONSTRUCTION UTILIZING ASSEMBLY LINE MODULES

[76] Inventor: Gary V. McWethy, P.O. Box 464, Batavia, N.Y. 14020

[21] Appl. No.: 447,433

[22] Filed: Dec. 6, 1982

Related U.S. Application Data

[63] Continuation-in-part of Ser. No. 245,019, Mar. 18, 1981.

[51] Int. Cl.[3] ..... E04H 1/00

[52] U.S. Cl. ..... 52/745; 52/79.11; 52/79.13; 52/234; 52/272

[58] Field of Search ..... 52/234, 79.1, 267, 272, 52/79.11, 745, 79.13, 79.14

[56] References Cited

U.S. PATENT DOCUMENTS

| | | | |
|---|---|---|---|
| 3,748,805 | 7/1973 | Boros | 52/745 |
| 3,751,864 | 8/1973 | Berger et al. | 52/79.11 |
| 4,078,345 | 3/1978 | Piazzalunga | 52/745 X |
| 4,107,886 | 8/1978 | Ray et al. | 52/79.11 |

FOREIGN PATENT DOCUMENTS

| | | | |
|---|---|---|---|
| 216721 | 8/1961 | Austria | 52/234 |
| 920146 | 3/1978 | Greece | 52/234 |
| 6709528 | 1/1968 | Netherlands | 52/79.1 |
| 2040334 | 8/1980 | United Kingdom | 52/79.1 |

*Primary Examiner*—Donald G. Kelly
*Assistant Examiner*—Naoko N. Slack
*Attorney, Agent, or Firm*—Michael L. Dunn; Donald C. Studley

[57] ABSTRACT

A method for constructing a multistory building comprising: constructing finished modules having a concrete base and vertical sidewalls; placing a first series of such modules at a single horizontal level such that at least one sidewall of each such module is spaced by a distance of from about 2 to about 12 inches from and is parallel to the sidewall of another such module; pouring and hardening concrete to fill at least a portion of the space between such sidewalls from the base to the top of such sidewalls to form supporting concrete walls; placing another additional series of such modules on the tops of the supporting concrete walls in the spaced relationship previously described and filling the spaces to form additional supporting concrete walls; and repeating the procedure previously described until the desired number of levels of modules is obtained.

In variations of the method, the base may be of a material other than concrete, the constructing of the modules occurs on an assembly line which may be near or distant from the site of construction of the building, and the sidewalls are of sufficient strength to support the weight of additional levels of modules or else vertical supporting members, other than concrete, are placed between the sidewalls from the base to the top of the sidewalls.

17 Claims, 5 Drawing Figures

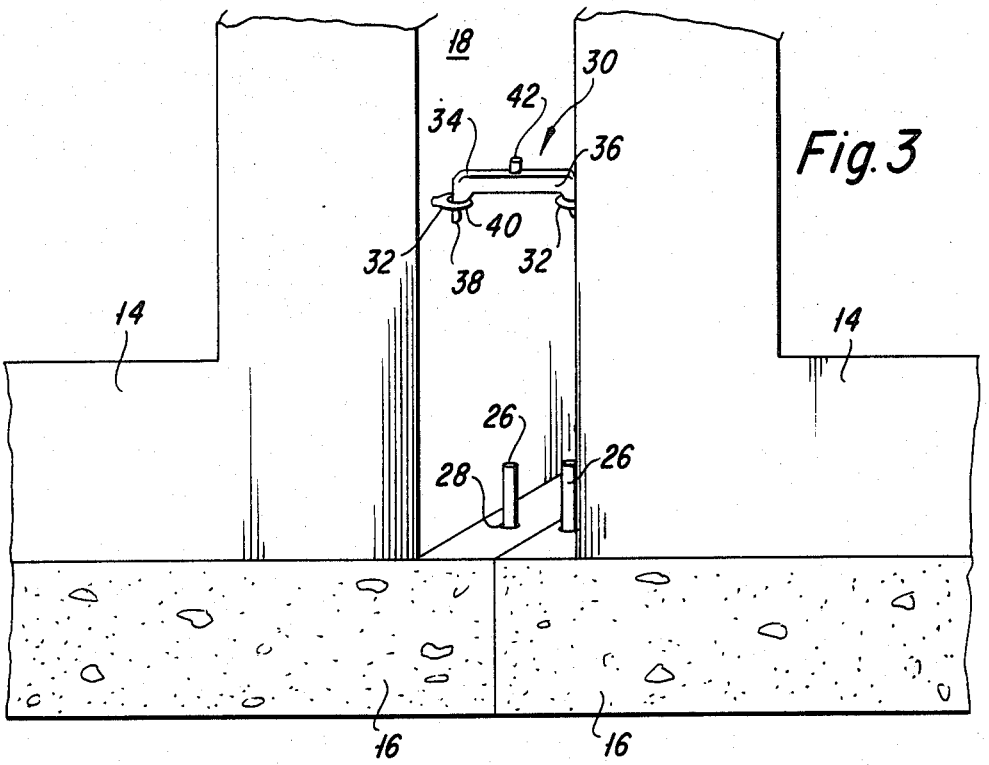
Fig. 3
Fig. 4
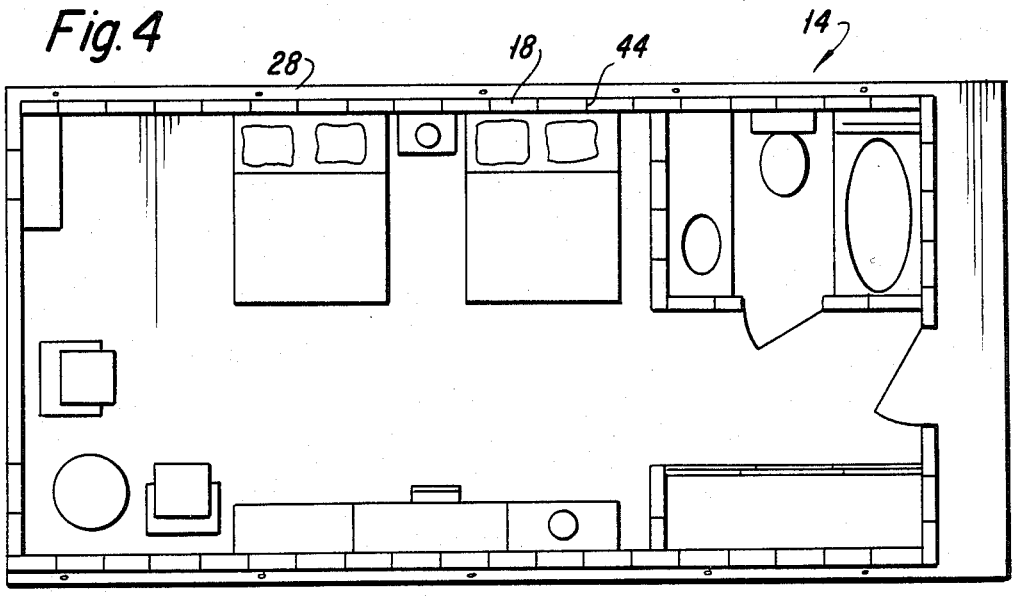

MODULAR HIGH RISE CONSTRUCTION UTILIZING ASSEMBLY LINE MODULES

This is a continuation-in-part of copending Patent Application Ser. No. 245,019, filed on Mar. 18, 1981.

BACKGROUND OF THE INVENTION (a) Field of the Invention

This invention relates to the construction of modular buildings and more particularly relates to multistory buildings formed by stacking preformed modules.

(b) History of the Prior Art

The construction of multistory buildings using construction modules is well known in the art. Examples of patents relating to such construction are numerous and include U.S. Pat. Nos. 3,694,977; 3,703,058; 3,721,052; 3,758,998; 3,919,812 and 4,129,968.

All of the foregoing patents relate to modular building construction and with the exception of U.S. Pat. Nos. 3,919,812 and 4,129,968 relate to multistory modular construction.

In the prior art, modular construction has been found to have various serious disadvantages. In particular, it has been felt that construction of finished modules for such modular construction should occur at a fixed factory location in order to obtain the benefits of assembly line manufacture. Such fixed location construction, however, has not been as efficient as desirable. Part of this inefficiency is due to the fact that finished modules must be transported from the fixed site to the construction site. Unless the modules were of small width, e.g., less than about 10 feet, such modules could not be transported on the highways and even when the modules were less than 10 feet, special regulations and procedures often had to be followed for transporting wide loads. The transportation costs involved in the transport of finished modules have therefore been much higher than desirable. Alternatively, when modules were made of a sufficiently narrow width to avoid special transportation problems, modules had to be joined at the construction site in order to obtain room sizes wider than about 8 feet.

Another problem involved with modular construction of multistory or high rise buildings has been that either the modules had to be constructed in such a way that they were not only self-supporting but could support modules placed at upper levels or alternatively independent super structures had to be built in order to support the modules. When the modules were constructed of sufficient strength to support upper modules levels, the bases and walls of the modules were generally constructed of reinforced concrete or steel or both. An example of unfinished modules having concrete bases and sidewalls are those sometimes formed on site by prior art tunnel forming (described in *Construction Contracting,* June 1980, pages 24–28). Such modules have great weight thus creating additional transportation difficulties when constructed at a plant or factory having a fixed location. Furthermore, when the walls of the modules were in the form of reinforced concrete, interior finishing of the modules was made more complicated since special procedures had to be followed to provide interior wall surfaces which did not have the cold feeling or nature of concrete surfaces. Furthermore, such concrete surfaces were difficult to insulate.

When the optional method of constructing super structures to hold the modules was used, the construction costs and difficulty dramatically rose due to the problems and the materials associated with super structure construction.

BRIEF DESCRIPTION OF THE DRAWINGS

FIG. 3 is a magnified view of area (a) of FIG. 2.

FIG. 4 is a plan view of a finished module manufactured by and for use in accordance with the method of the invention.

BRIEF DESCRIPTION OF THE INVENTION

Figure 1:
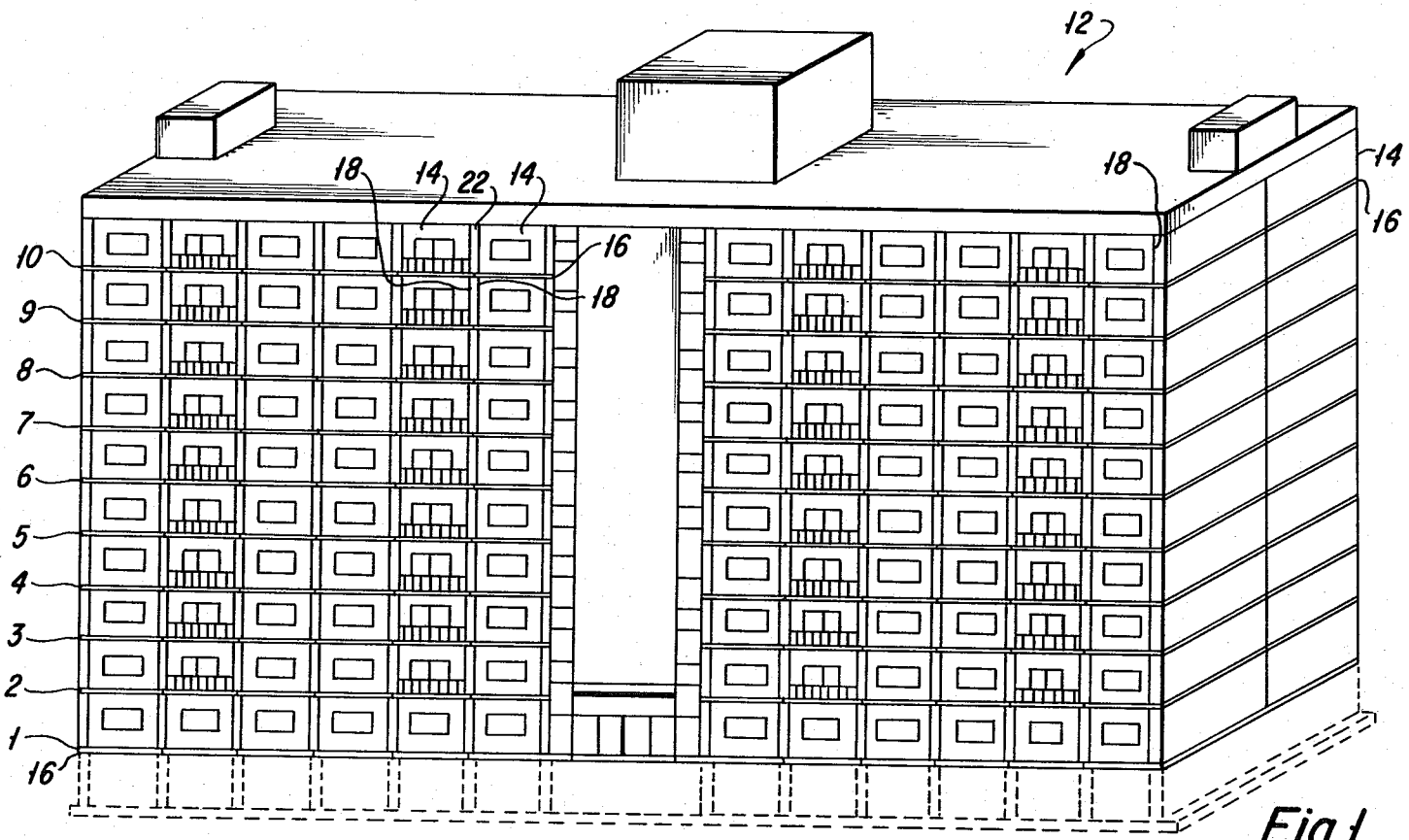
FIG. 1 is a perspective view of a multistory building, the major portion of which is manufactured in accordance with the method of the invention.

In accordance with the present invention, there is provided a method for constructing a multistory building by using modules which overcomes essentially all of the previously discussed prior art problems. Sidewalls of the modules are not necessarily required to be constructed of a material sufficiently strong to support the modules placed at higher levels nor is a super structure in the traditional sense required. The modules can therefore be much lighter thus reducing transportation problems associated with modules prefabricated at a factory site. Furthermore, in accordance with one embodiment of the present invention, modules can be manufactured at the building construction site thus almost entirely eliminating such transportation problems.

The method for constructing a multistory building in accordance with the present invention comprises constructing finished modules having a reinforced concrete base at least 2 inches thick and having vertical sidewalls. The construction of the modules may occur near the ground at the site of the construction of the multistory building. A series of such finished modules are placed with their bases at a single horizontal level in relationship with each other such that at least one sidewall of each module is spaced by a distance of from about 2 to about 24 and usually to about 12 inches from and is parallel to the sidewall of another such module.

After the modules are so placed, concrete is poured between such spaced sidewalls and hardened to fill at least a portion of the space between the sidewalls from the base to the top of the sidewalls to form supporting concrete walls.

After the supporting concrete walls are formed, an additional series of the finished modules are placed upon the tops of the previously poured and hardened supporting concrete walls such that the bases of the modules in the additional series are in a horizontal level at the tops of the previously poured and hardened supporting concrete walls. The modules in the additional series are in relationship with each such that at least one sidewall of the each module is spaced by a distance of from about 2 to about 24 inches from and is parallel to the sidewall of another such module as was the case in the previous level. After the sidewalls are so spaced at the additional level, concrete is again poured and hardened between such space in sidewalls of the modules in the additional series to fill at least a portion of the space between such sidewalls to form additional supporting concrete walls.

As a modification of the method, the base may be concrete or made of a material other than concrete and instead of pouring concrete between the sidewalls, vertical supporting members may be placed at a position which will be located between such sidewalls from the base to the top of such sidewalls. Additional series of finished modules are then placed at, preferably on, the tops of the previously placed vertical supporting members as previously described in relation to supporting concrete walls. In another modification of the method, the base may again be other than concrete. The modules are placed so that at least one sidewall of each module is proximate and parallel to the sidewall of another module. At least a portion of such sidewalls are of sufficient strength to support the weight of additional modules at additional higher levels resting on the sidewalls. Other additional series of finished modules at other horizontal levels are then placed upon the tops of the sidewalls of the modules in the previous level.

In all cases, additional series of modules may continue to be placed at continuously higher levels until the desired number of levels is obtained.

The finished modules may be constructed at a factory but are most desirably constructed in an assembly line operation located at the construction site, thus all of the advantages of modular construction are retained while disadvantages are reduced. It may, however, be advantageous to construct the modules on a factory assembly line to avoid setting up an assembly line on the building site.

DETAILED DESCRIPTION OF THE INVENTION

"Multistory building", as used herein, means a building of two or more stories. A "finished" module is a module containing at least all major construction items including interior floor, walls and ceiling, wall coverings with or without finishing coatings, most insulation and plumbing and electrical lines. Desirably, the finished module also includes floor coverings, electrical and plumbing fixtures, cabinets, doors, woodwork and even furnishings.

The base of the module is desirably concrete reinforced with suitable steel rods or mesh but, in modifications of the method as previously described, may be of other materials such as wood or steel. When the base is concrete, it is at least two inches, preferably at least two and one-half inches and even more preferably, at least three inches thick. The sidewalls and ceiling may be made of any suitable material including reinforced concrete and heavy steel or wood frame, but are preferably of light steel frame or wooden frame construction with a veneer or construction board exterior surface when supporting concrete walls are poured within the spaces between sidewalls in accordance with the preferred embodiment or when vertical supporting members other than concrete are used. Such other types of vertical supporting members are usually steel or wood columns or posts.

The construction of the modules desirably, but not necessarily, occurs near the ground at the site of the construction of the multistory building. "Near the ground", as used herein, means that the base of the module is usually within three feet of the ground. Such construction is usually conducted in an on site or factory assembly line wherein bases are formed, e.g., when concrete is poured and hardened. The remainder of the module is constructed upon the base at consecutive construction stations. Either the station or modules, and preferably the modules, are moved relative to the other. The modules, for example, may be moved along a conveyor or track. The construction stations themselves are transportable for movement from one multistory building construction site to another.

A first series of finished modules are placed with their bases at a single horizontal level (on a foundation). When supporting concrete walls or vertical supporting members are used, the modules are in relationship with each other such that at least one sidewall of each module is spaced by a distance of from about 2 to about 24 inches from and is parallel to the sidewall of another such module. After a pair of such modules are so spaced relative to each other, they are desirably secured to each other by any suitable means. Such a means, in accordance with the present invention, comprises steel connectors which are preferably eyes, in each module, connected by wedges or pins. While such first series is being placed, construction of additional modules can simultaneously continue.

After modules are spaced and secured as previously described, concrete is poured and hardened between spaced sidewalls to fill at least a portion of the space between such sidewalls from the base to the top of such sidewalls to form supporting concrete walls. Desirably, reinforcing rods and mesh are provided within the space prior to pouring the concrete. Or when vertical supporting members are used, the supporting members are placed before both modules are placed to form the space between the sidewalls. Placing of the vertical supporting members before both modules permits the vertical member to be secured to the vertical member at the previous level or to the foundation.

Desirably, when concrete supportng walls are used, each such wall is provided with pins or rods which extend upwardly from the top of the wall. The pins or rods are provided to mate with openings in the base of the next module which is to be placed and rest on the top of the wall. The supporting concrete walls may extend along a part or the entire length of the sidewall of the module.

In the case of poured concrete supporting walls, after all or a portion of the first series of finished modules is placed and supporting concrete walls poured and hardened, an additional series of such finished modules is placed upon the tops of the previously poured and hardened supporting concrete walls such that the bases of the modules in the additional series of modules are at a horizontal level at the tops of the previously poured and hardened supporting concrete walls. The additional series are placed and secured as in the first series such that at least one sidewall of each module is spaced by a distance of from about 2 to about 24 inches from and is parallel to the sidewall of another such module. The spaces between the modules are then filled with concrete as previously described.

Further additional series of finished modules may be placed upon or at the tops of previously poured and hardened supporting walls, vertical members or supporting sidewalls until the desired number of levels of modules is obtained.

A better understanding of the invention may be had by reference to the drawings.

FIG. 1 illustrates a multistory building 12, the majority of which is manufactured in accordance with the method of the invention. As can be seen in this drawing, the building is constructed of finished modules 14 having reinforced concrete bases 16. The modules are stacked in a plurality of series with their bases at horizontal levels 1 through 10. Each of the modules at a single level are in relationship with each other such that at least one sidewall 18, is spaced by a distance of from about 2 to about 24 inches from and is parallel to another sidewall 18 of another such module. Concrete is poured and hardened between the spaced sidewalls to form supporting concrete walls, e.g., supporting concrete wall 22. As can be seen in FIG. 1, additional series of such finished modules 14 are placed upon the tops of the previously poured and hardened supporting concrete walls 22 such that the bases 16 of the modules 14 in the additional series are at another horizontal level at the tops of the previously poured and hardened supporting concrete walls 22. Additional series of modules continue to be stacked upon previously poured and hardened supporting concrete walls 22 until the desired number of levels of modules 14 are obtained.

Figure 2:
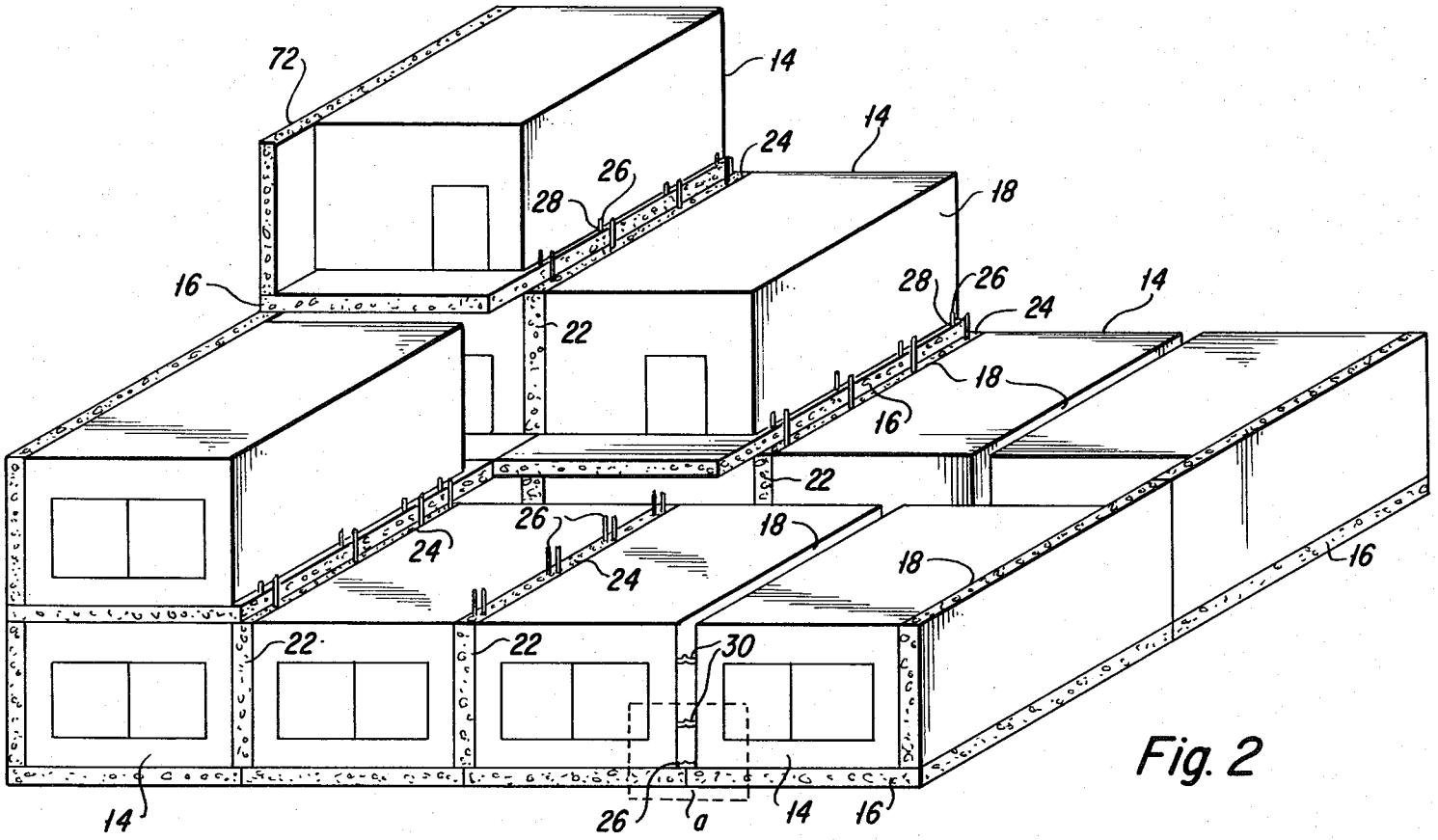
FIG. 2 is a simplified perspective view of a multistory building under construction in accordance with the method of the invention.

FIG. 2 illustrates a multistory building under construction in accordance with the method of the invention. This drawing more clearly depicts bases 16 of finished modules 14 and sidewalls 18 can be more easily seen. As can be seen in FIG. 2, the tops 24 of reinforced concrete walls 22 are provided with upwardly extending pins 26 which pins mate with openings 28 in bases 16. Modules 14 are placed such that sidewalls 18 are spaced as previously described. The distance between sidewalls 18 of modules 14 is retained by steel connectors 30 prior to pouring supporting concrete walls 22.

FIG. 3 illustrates a magnified view of section a of FIG. 2. This magnified view more clearly shows a connector 30 which comprises eyes 32 and connecting wedge 34. Connecting wedge 34 consists of a horizontal bar 36 and downwardly extending wedge shaped portions 38 provided with grooves 40 for engaging eyes 32. Connecting wedge 34 is also provided with a central threaded lug 42 which mates with threaded rod (not shown) for more easily placing connecting wedge 34 into eyes 32.

FIG. 3 also more clearly shows pins 26 which mate with holes 28 in base 16.

FIG. 4 shows a plan view of a finished module 14. As can be seen in FIG. 4, sidewalls 18 can be of frame construction as illustrated by wall studs 44. The frame construction is a wooden frame construction when studs 44 are of wood material.

Figure 5:
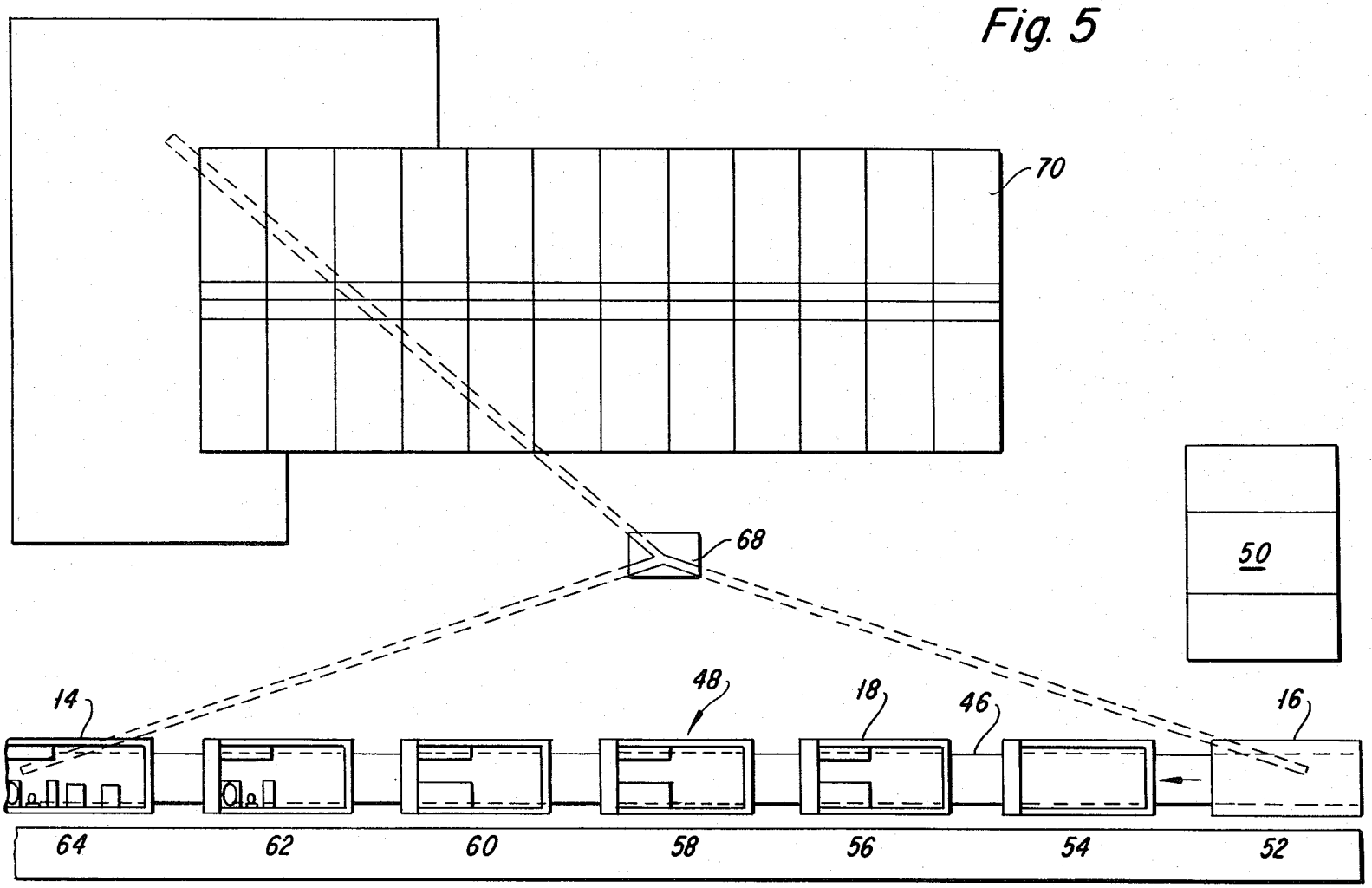
FIG. 5 is a plan view of a site for constructing a multistory building in accordance with the method of the invention.

FIG. 5 is a construction site designed for utilization of the method of the invention. As can be seen in FIG. 5, a base 16 is constructed by pouring and curing the reinforced concrete base which is then conveyed along tracks 46 of assembly line 48. Bases 16 may be poured, hardened and stored at station 50. Base 16 is then conveyed along assembly line 48 through various construction stations 52 through 64 until a finished module 14 is completed. A tower crane 68 then lifts finished module 14 into its appropriate location in multistory building 70. When modules are manufactured at an off site factory, a similar assembly line is used. Such modules are then shipped to the building site and incorporated into the building as previously described.

Sidewalls 18 may be of wooden frame construction as previously described or may be of concrete construction as illustrated by sidewall 72 in FIG. 2. Such a concrete construction is particularly desirably when sidewall 72 is an exterior wall. Such a preformed concrete sidewall 72 eliminates the need for forming a supporting concrete wall 22 at the exterior of the building after finished modules 14 are in place. In the absence of an exterior concrete wall 72, either an exterior supporting concrete wall 22 or supporting columns are usually required.

What is claimed is:

1. A method for constructing a multistory building which comprises:

(a) constructing finished modules having a reinforced concrete base at least 2 inches thick and having vertical sidewalls, said base extending beyond said sidewalls about one-half the distance that the modules are to be spaced apart in the finished building;

(b) placing first series of such finished modules with their bases at a single horizontal level in relationship with each other such that at least a portion of one sidewall of each module is spaced by a distance of from about 2 to about 24 inches from and is parallel to the sidewall of another such module;

(c) securing said modules together by mechanically connecting said sidewalls;

(d) pouring and hardening concrete between such spaced sidewalls and extended base portions to fill at least a portion of such space to form supporting concrete walls;

(e) placing an additional series of such finished modules upon the tops of the previously poured and hardened supporting concrete walls such that the bases of the modules in the additional series are at a horizontal level at the tops of the previously poured and hardened supporting concrete walls, the modules in the additional series being in relationship with each other such that at least a portion of one sidewall of each such module is spaced by a distance of from about 2 to about 24 inches from and is parallel to the sidewall of another such module; and (f) pouring and hardening concrete between such spaced sidewalls and extended base portion of the modules in the additional series to fill at least a portion of such space to form additional supporting concrete walls.

2. The method of claim 1 wherein steps (e) and (f) are repeated until the desired number of levels of modules is obtained.

3. The method of claim 2 wherein the finished modules are constructed in an assembly line operation.

4. The method of claim 2 wherein the finished modules are constructed in an assembly line operation located near the ground at the site of construction of the multistory building.

5. The method of claim 2 wherein the finished module is constructed by first pouring and curing the reinforced concrete base which base is then conveyed through various construction stations until a finished module is completed.

6. The method of claim 2 wherein the distance between sidewalls of the modules is retained by steel connectors prior to pouring the supporting concrete walls.

7. The method of claim 2 wherein the supporting concrete walls are formed of reinforced concrete, each such supporting concrete wall having pins upwardly extending from its top, which pins mate with openings in the base of a module resting on said supporting concrete wall.

8. The method of claim 2 wherein the sidewalls are wooden frame walls.

9. The method of claim 2 wherein the sidewalls are concrete sidewalls.

10. The method of claim 1 wherein the finished module is constructed by first pouring and curing the reinforced concrete base which base is then conveyed through various construction stations until a finished module is completed.

11. The method of claim 1 wherein the distance between sidewalls of the modules is retained by steel connectors prior to pouring the supporting concrete walls.

12. The method of claim 1 wherein the supporting concrete walls are formed of reinforced concrete, each such supporting concrete wall having pins upwardly extending from its top, which pins mate with openings in the base of a module resting on said supporting concrete wall.

13. The method of claim 1 wherein the sidewalls are wooden frame walls.

14. The method of claim 1 wherein the sidewalls are concrete sidewalls.

15. A method for constructing a multistory building which comprises:

(a) constructing finished modules having a base and having vertical sidewalls, said base extending beyond said sidewalls about one-half the distance that the modules are to be spaced apart in the finished building, such constructing occurring near the ground on an assembly line at the site of the constructing of said multistory building;

(b) placing a first series of such finished modules with their bases at a single horizontal level in relationship with each other such that at least one sidewall of each module is proximate and parallel to the sidewall of another such module, at least a portion of each of said proximate and parallel sidewalls being of sufficient strength to support the weight of additional modules at additional higher levels resting on said sidewalls;

(c) spacedly securing said modules together by mechanically connecting said sidewalls;

(d) pouring and hardening concrete between such spacedly secured sidewalls to fill at least a portion of such space to form supporting concrete walls; and, (e) placing an additional series of such finished modules upon the tops of the sidewalls such that the bases of the module in the additional series are at a horizontal level at the tops of the sidewalls of the modules in the previous level, so that the extended portions of the module base substantially span the space between the sidewalls in the series below.

16. The method of claim 15 wherein the construction of the modules occurs near the ground on an assembly line at the site of the construction of said multistory building.

17. A method for constructing a multistory building which comprises:

(a) constructing finished modules having a base and having vertical sidewalls, said base extending beyond said sidewalls about one-half the distance that the modules are to be spaced in the finished building;

(b) placing a first series of such finished modules with their bases at a single horizontal level in relationship with each other such that at least a portion of one sidewall of each module is spaced by a distance of from about 2 to about 24 inches from and is parallel to the sidewall of another such module;

(c) prior to placing such modules in said relationship, placing vertical supporting members in the space to be located between such sidewalls and extended portion of such base from the base to the top of such sidewalls;

(d) securing such modules together by mechanically connecting said sidewalls;

(e) placing an additional series of such finished modules at the tops of the previously placed vertical supporting members, the modules in the additional series being in relationship with each other such that at least a portion of one sidewall of each module is spaced by a distance of from about 2 to about 24 inches from and is parallel to the sidewall of another such module; and (f) utilizing the extended portions of said base to mechanically secure each series together.

* * * * *